US005147714A

United States Patent [19]

Ellison et al.

[11] Patent Number: 5,147,714

[45] Date of Patent: Sep. 15, 1992

[54] ANTISTATIC REINFORCED FABRIC CONSTRUCTION

[75] Inventors: James R. Ellison, Leesburg; Robert W. Hoy, Warsaw, both of Ind.

[73] Assignee: ABC Industries, Inc., Warsaw, Ind.

[21] Appl. No.: 612,003

[22] Filed: Nov. 9, 1990

[51] Int. Cl.[5] ..... B32B 7/00

[52] U.S. Cl. ..... 428/254; 66/195; 428/246; 428/247; 428/253; 428/283; 428/408; 428/922

[58] Field of Search ..... 428/247, 253, 257, 246, 428/254, 408, 922, 283; 66/195

[56] References Cited

U.S. PATENT DOCUMENTS

| | | | |
|---|---|---|---|
| 3,542,633 | 11/1970 | Goldsmith | 161/87 |
| 3,582,448 | 6/1971 | Okuhashi et al. | 161/87 |
| 3,733,606 | 5/1973 | Johansson | 343/18 A |
| 3,891,786 | 5/1973 | Conklin | 428/136 |
| 4,153,749 | 5/1979 | Klein | 428/95 |
| 4,296,855 | 10/1981 | Blalock | 428/244 |
| 4,307,144 | 12/1981 | Sanders et al. | 428/240 |
| 4,323,613 | 4/1982 | Snyder | 428/111 |
| 4,420,529 | 12/1983 | Westhead | 428/257 |
| 4,443,516 | 4/1984 | Rogers | 428/257 |
| 4,615,934 | 10/1986 | Ellison | 428/253 |
| 4,623,951 | 11/1986 | DuPont et al. | 428/116 |
| 4,889,963 | 12/1989 | Onai | 174/129 R |
| 4,902,562 | 2/1990 | Babia | 428/283 |

OTHER PUBLICATIONS

Bruin Plastics Co. of Glendale, RI, "BRUN-TUFF" product brochure Duracote Corp. of Ravina, OH, "Durohm" product brochure.

Herculite Products of New York, NY, "Staph Chek Laboratory Report" Herculite Products, "LECTROLITE" product brochure.

*Primary Examiner*—James J. Bell

*Attorney, Agent, or Firm*—Woodward, Emhardt, Naughton, Moriarty & McNett

[57] ABSTRACT

An antistatic laminated fabric having conductive tie yarns and a non-woven scrim which is laminated between two conductive sheets of PVC film. In one embodiment, all yarns in the warp direction are of the same denier, and the yarns in the weft direction are likewise all of the same denier. In another embodiment, heavier yarns are laid in regular intervals in both fabric directions.

22 Claims, 2 Drawing Sheets

ANTISTATIC REINFORCED FABRIC CONSTRUCTION

BACKGROUND OF THE INVENTION

This invention relates to reinforced fabric constructions and more particularly to antistatic reinforced fabric constructions.

Resistance to the buildup of static electricity is required in addition to physical properties such as adequate tear strength for fabrics in numerous applications, such as in the mining and tunneling industries, the aerospace and electronics industries, and the medical field, among others. Laminated fabrics, i.e., fabric-reinforced sheets of vinyl or the like, are known to provide superior physical properties, and are also commercially available with varying levels of antistatic properties. One such product is a 3-ply laminate consisting of a substrate of synthetic scrim between two layers of vinyl film one or both of which contain carbon. A 4-ply laminate is also available in which a layer of carbon is buried alongside the scrim between two outer layers of PVC film. Such a construction makes it possible to choose a color other than carbon black for a laminated fabric with antistatic properties, and therefore has some advantage over simpler constructions from a general aesthetic standpoint, and also from a safety standpoint in applications where color is important. For example, white or yellow fabric is preferred in the mining industry for increased visibility underground. However, a 4-ply laminate generally requires additional material and is more complex to manufacture than a 3-ply laminate.

Another known method of imparting antistatic properties involves plastisol coating a scrim with a film containing an antistatic ingredient. However, such coated fabrics have been found to have unstable electrical properties. This is believed to be due to the temperature conditions encountered during the plastisol coating process, as a result of which the antistatic ingredient "blooms" to the surface and then dissipates over time. Plastisol coating is also time-consuming, which results in relatively high production costs and relatively low production rates, two disadvantages which have not heretofore been outweighed by the quality of the resulting antistatic product.

All of the known antistatic fabric constructions suffer from certain shortcomings, either in their electrical properties, availability of colors, fabric strength, other physical properties, or cost.

SUMMARY OF THE INVENTION

The present invention provides a significant improvement over the prior art in the form of an antistatic fabric having a conductive scrim in addition to at least one conductive layer of thermoplastic synthetic resin. In one aspect of the invention, a conductive synthetic knitting yarn or tie yarn is employed in a synthetic scrim which is laminated between two conductive sheets of thermoplastic synthetic resin.

A general object of the present invention is to provide an improved antistatic fabric.

Another object of the invention is to provide improved antistatic properties for reinforced fabric constructions.

An object of one aspect of the invention is to provide an antistatic laminated fabric with antistatic properties that are stable over time.

An object of another aspect of the invention is to provide an antistatic 3-ply laminate available in a variety of colors.

An object of a further aspect of the invention is to maintain relatively low manufacturing costs as well as advantages such as antistatic qualities meeting requirements for severe environments such as in the mining industry, as well as tear strength and color choices suitable in such environments.

An object of yet another aspect of the invention is to provide a reinforced fabric construction in which the reinforcing substrate is markedly less expensive than woven scrim and which has antistatic properties suitable for a variety of applications.

These and other objects and advantages of various aspects of the present invention will become more apparent from the following detailed description of the preferred embodiment and from the accompanying drawings.

DESCRIPTION OF THE PREFERRED EMBODIMENT

Figure 1:
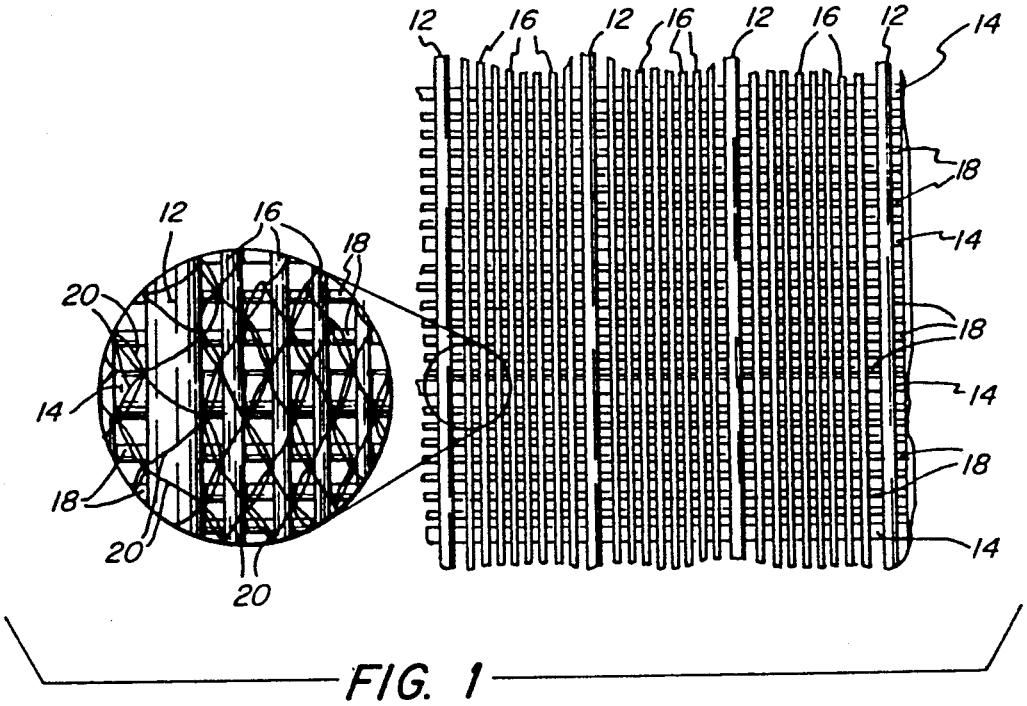
FIG. 1 is a plan view of an antistatic substrate for an antistatic laminated fabric according to the present invention, with a small section thereof shown in magnified form.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The warp knit insertion fabric shown in plan view in FIG. 1 is a section of a typical fabric of the invention. The warp yarns 12 are of relatively heavy denier and are separated from each other by eight warp yarns 16 of lighter denier. Similarly the weft insertion yarns 14 are of relatively heavy denier and are separated from each other by eight yarns 18 of lighter denier. As shown more clearly in the magnified section offset from FIG. 1, the various warp and weft yarns are held in spaced apart relationship by much finer knitting or tie yarn 20 which has a denier of about 30 to about 90.

The heavier denier yarns 12 and 14 can be of equal or different denier and each has a denier within the range of about 500 to about 6000, and preferably within the range of about 1000 to about 5200. The lighter denier yarns 16 and 18 can also be equal or different in denier and each has a denier within the range of about 220 to about 1800, provided that the ratio of denier of the heavier yarns 12 and 14 to that of the lighter yarns 16 and 18 is within the range of about 1.5 to about 6:1.

The number of yarns per inch in both the warp and the weft can vary over a wide range, being limited only by the capabilities of the machine used in fabrication, and is advantageously of the order of about 1 to about 25 yarns per inch and, preferably, of the order of about 6 to about 18 per inch.

The yarns employed in both the warp and the weft, whatever the particular denier employed, can be the same or different and are selected independently from homogeneous yarns, plied, and "machine-plied" yarns. The latter type of yarns are homogeneous yarns which have been plied during the knitting process as will be discussed below. The yarns can be natural yarns but are preferably fabricated from synthetic materials such as polyesters and polyamides, such as nylon, dacron, aramids, Kevlar ®, and the like, carbon fibers, fiber-glass, rayon, cotton and the like. Particularly preferred yarns for use in the fabric of the invention are polyester yarns.

Fabrics according to the invention can be prepared using conventional warp knit machinery by feeding the appropriate arrangement and weights of yarn in both the warp and weft. Where the yarns, particularly the heavier yarns in both warp and weft, are to be "machine plied", this can also be accomplished using conventional warp knit machinery using the following procedure. For the yarns in the weft direction, spools of yarn, of a lesser mass than that in the desired machine-plied yarn but such that the total mass of the yarns equals that of the desired yarn, are loaded in a creel. The yarns are then threaded (in tandem or in whatever combination is necessary to achieve the desired mass in the "machine-plied" yarn) through the normal yarn path, i.e., through tension posts, thread guide rails, weft carriage, displacement rakes, around weft transport hooks (on a transport chain) and into the knitting elements. Similarly, in the case of the yarns in the warp direction the appropriate beam containing yarns of the lesser mass (having a total mass which will equal the desired level in the machine plied yarn) is selected and, having determined the appropriate grid sizing and spacing, the yarns are threaded (in tandem or whatever combination is necessary to achieve the desired mass in the "machine-plied" yarn) through the normal yarn path, i.e., through guide bars, warp feed rolls, and thread guides and into the knitting elements.

Figure 2:
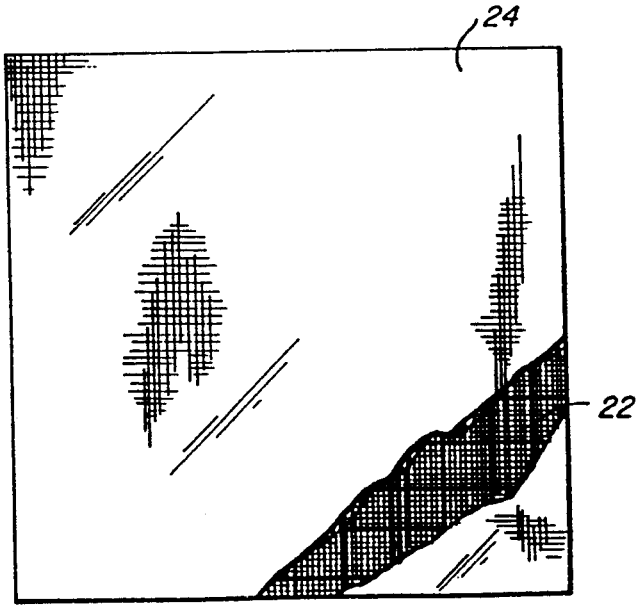
FIG. 2 is a plan view of an antistatic laminated fabric according to the present invention, with a portion of the top layer peeled off to show the reinforcing layer.

In FIG. 2, there is illustrated in plan view a typical reinforced polymeric resin sheet 24 in accordance with the invention. The reinforcing fabric, in the particular embodiment shown, is the warp knit weft insertion fabric 22 a portion of which is seen in the cutaway portion of the sheet 24. The polymeric resin can be any of the resins commonly employed in preparing such sheets. Illustrative of such polymeric resins are polyvinyl chloride (PVC), polyvinyl fluoride, polyurethane, ABS, polyamides such as nylon, dacron and the like, polyethylene, Mylar ®, and the like. The reinforcing fabric 22 can be incorporated in the polymeric resin by any of the conventional techniques such as lamination, i.e., heat bonding the reinforcing fabric between two sheets of the polymeric resin, coating the fabric with the molten polymeric resin and like techniques. The thickness of the sheets so produced can vary widely depending upon the application to which the sheet is to be put. Advantageously, the sheets have a thickness of the order of about 0.0025 to about 0.025 inches.

The preferred embodiment of the present invention provides significantly improved antistatic properties through a combination of conductive elements in the laminated fabric of FIGS. 1 and 2. Both sheets or film layers 24 and tie yarns 20 are conductive. The conductivity of the scrim introduced by the tie yarns combines with that of the film layers to reduce the resistance of the finished laminated fabric to desired levels without limiting the choices of color or sacrificing other desired qualities. The conductivity of the outer layers 24 is substantially increased by an additive, Barostat 318S, which is commercially available from Chemische Werke Muenchen Otto Baerlocher GMBH, Munich, Germany. The additive is mixed with raw resin material, a plasticizer and colorants in a conventional manner in a Banbury mixer, and the resulting molten film compound is calendered into a film sheet. While the precise formulation of the film will vary according to application, the presently preferred formulation for film to be used in white antistatic laminated fabric for mining applications is as follows, with all ingredients designated in parts by weight:

| Antistatic Formulation | |
|---|---|
| PVC Resin (I. v. 1. oz.) | 100.0 |
| Whiting (calcium carbonate) | 10.0 |
| Phthalate-type Plasticizer | 31.5 |
| Antimony Trioxide | 6.0 |
| Stearic Acid | 1.0 |
| Acrylic Processing Aid | 2.0 |
| Ba/Cd/Zn Heat & Light Stabilizer | 4.0 |
| Antistatic Agent (Barostat 318S) | 10.0 |
| Epoxidized Soya Oil | 3.0 |
| Phosphite Chelatol | 1.0 |
| White Pigment Paste (65% Titanium Dioxide) | 20.0 |
| | 188.5 |

Figure 3:
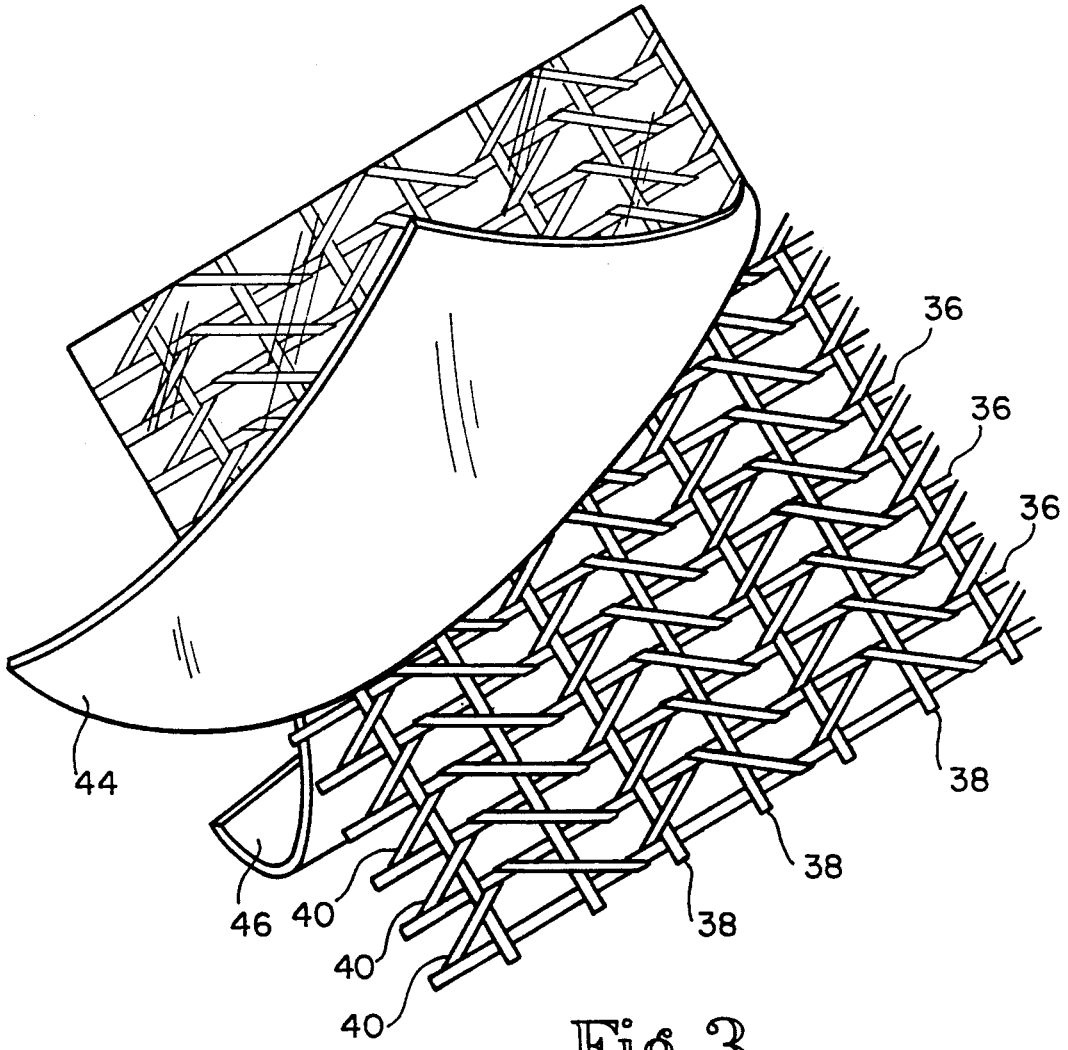
FIG. 3 is an isometric view of an alternative embodiment of an antistatic laminated fabric according to the present invention.

The conductivity of the substrate is primarily determined by the tie yarn 20, which is preferably 40-denier conductive nylon 6 monofilament having the electrical properties of BASF F-901 yarn, i.e., approximately $2\times10^5$ ohms/cm per BASF test procedure TBM-73-3. Such yarn is commercially available from BASF Corporation, Fibers Division, Williamsburg, Va. Alternatively, in applications where greater tear strength is desired, such as in the Canadian mining industry, a 160-denier tie yarn may be used instead of the 40-denier yarn described above, with the electrical properties remaining the same. The 160-denier yarn is preferably composed of one strand of 20-denier conductive nylon 6 monofilament plied with two strands of 70-denier 32-filament polyester yarn. One advantage of the 40-denier yarn is that it results in a thinner finished product. Further description of the scrim described above may be found in U.S. Pat. No. 4,615,934, which is hereby incorporated by reference. As an alternative to such a scrim construction, a conventional scrim may be employed in which all yarns in each direction of the fabric are of the same denier. An antistatic laminated fabric according to this alternative embodiment of the present invention is shown in FIG. 3. The warp yarns 36 and weft yarns 38 may be the same as the corresponding yarns 16 and 18 in the embodiment of FIGS. 1 and 2, and, as with that embodiment, the number of yarns per inch in both the warp and the weft can vary over a wide range, and the yarns employed in both directions can be the same or different and are selected independently. Similarly, the same conductive yarn may be used for tie yarn 40 as for tie yarn 20 shown in FIG. 1. Sheets 44 and 46 may, likewise, be the same as sheet 24 shown in FIG. 2.

An antistatic laminated fabric with a conventional weft insertion scrim of the type shown in FIG. 3 is suitable for numerous applications including brattice cloth and mine curtains and probably the majority of applications in the medical field. It is presently envisioned that the scrim for medical grade fabrics will have polyester yarns in a 9×9 count, 1000×1000 denier, as well as in a 9×4 count, 1000×500 denier. Alternative constructions include 18×9 count and 18×14 count, among others, and the denier on the various constructions could range anywhere from 220 to 1800. Also, the combination of deniers could vary significantly for each construction.

A prototype 3-ply laminate was constructed according to the embodiment of FIGS. 1 and 2, with 9×9 polyester scrim, 40-denier tie yarn as described above, with the outer layers both yellow in color but otherwise according to the formulation listed above, with 3-mil thickness for each sheet, and with the yarn denier selected to produce a weight of 14 to 15 ounces per square yard for the complete laminated fabric. The electrical resistance of this prototype product was tested according to the method of the National Coal Board (now the United Kingdom Coal Board), N.C.B. Specification No. 158-1971, and values in the range of 5 to 30 megohms were obtained. The particular colorant employed in the formulation is believed to have a negligible effect on the fabric conductivity, and so it is expected that similar test results could be obtained with laminates whose outer layers are white, clear or virtually any other color, the choice of colors being limited essentially only by the number of different colorants available for such resins. This feature, among others, renders the invention useful in a wide variety of applications, including brattice cloth, mine curtains, and flexible blower tubing in the mining industry, upholstery for wheelchairs, examination tables, gurneys, etc., and other medical grade fabrics, in the medical field, covers and curtains for rockets and associated equipment, and covers for computers and other sensitive equipment in all fields, to mention but a few.

For some applications, a conductive scrim according to the teachings of the present invention may be adequate with a plastisol coating which includes an antistatic agent. Such a construction would be an improvement over existing coated fabrics in terms of its electrical properties, and could warrant the added expense of the plastisol coating process in certain applications, although the laminated construction described above is believed to be superior because of the greater stability of its electrical properties and because it would be more economical.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An antistatic laminated fabric, comprising:
a fabric substrate having a plurality of warp yarns and weft yarns interconnected by conductive tie yarn; and
a pair of conductive sheets of thermoplastic synthetic resin, one of said conductive sheets bonded to each side of said fabric substrate.

2. The antistatic laminated fabric of claim 1, wherein said conductive tie yarn includes a carbon-coated monofilament.

3. The antistatic laminated fabric of claim 2, wherein said conductive tie yarn further includes a nonconductive synthetic yarn plied with said carbon-coated monofilament.

4. The antistatic laminated fabric of claim 3, wherein said monofilament is nylon and said synthetic yarn is polyester.

5. The antistatic laminated fabric of claim 4, wherein said conductive sheets of thermoplastic synthetic resin are polyvinyl chloride film having a conductive additive blended therein.

6. The antistatic laminated fabric of claim 5, wherein said nylon monofilament has a denier less than approximately 50.

7. The antistatic laminated fabric of claim 1, wherein said conductive sheets of thermoplastic synthetic resin are polyvinyl chloride film having a conductive additive blended therein.

8. The antistatic laminated fabric of claim 1, wherein said tie yarn includes conductive nylon monofilament of denier less than approximately 5.

9. An antistatic knitted fabric, comprising:
a plurality of substantially nonconductive warp yarns;
a plurality of substantially nonconductive weft yarns; and
conductive tie yarn interconnecting said substantially nonconductive warp and weft yarns.

10. The antistatic laminated fabric of claim 9, wherein said conductive tie yarn includes a carbon-coated monofilament.

11. The antistatic laminated fabric of claim 10, wherein said conductive tie yarn further includes a nonconductive synthetic yarn plied with said carbon-coated monofilament.

12. The antistatic laminated fabric of claim 11, wherein said monofilament is nylon and said synthetic yarn is polyester.

13. The antistatic laminated fabric of claim 12, wherein said nylon monofilament has a denier less than approximately 50.

14. The antistatic laminated fabric of claim 9, wherein said tie yarn includes conductive nylon monofilament of denier less than approximately 50.

15. An antistatic knitted fabric, comprising:
a fabric substrate having a plurality of warp yarns, a plurality of weft yarns, and conductive tie yarn interconnecting said warp and weft yarns; and
a layer of thermoplastic synthetic resin on at least one side of said fabric substrate.

16. The antistatic laminated fabric of claim 15, wherein said warp and weft yarns are substantially nonconductive.

17. The antistatic laminated fabric of claim 16, wherein said layer of thermoplastic synthetic resin is conductive.

18. The antistatic laminated fabric of claim 17, wherein said conductive layer of thermoplastic synthetic resin is polyvinyl chloride film having a conductive additive blended therein.

19. The antistatic laminated fabric of claim 18, further comprising a layer of thermoplastic synthetic resin on each side of said fabric substrate.

20. The antistatic laminated fabric of claim 19, wherein said fabric substrate is laminated between two sheets of said thermoplastic synthetic resin.

21. The antistatic laminated fabric of claim 19, wherein said fabric substrate is coated with said thermoplastic synthetic resin.

22. The antistatic laminated fabric of claim 15, wherein said layer of thermoplastic synthetic resin is polyvinyl chloride film having a conductive additive blended therein.

* * * * *

UNITED STATES PATENT AND TRADEMARK OFFICE

CERTIFICATE OF CORRECTION

PATENT NO. : 5,147,714

DATED : September 15, 1992

INVENTOR(S) : James R. Ellison et al.

It is certified that error appears in the above-identified patent and that said Letters Patent is hereby corrected as shown below:

Col. 6, line 3, claim 8, change "5" to --50--
Columns 6-8, line 1, claims 10-14, and 16-22, change "laminated" to --knitted--.

Signed and Sealed this

Twenty-second Day of March, 1994

Bruce Lehman

*Attest:*

BRUCE LEHMAN

*Attesting Officer*

*Commissioner of Patents and Trademarks*